US010271590B2

(12) United States Patent
Henry et al.

(10) Patent No.: US 10,271,590 B2
(45) Date of Patent: Apr. 30, 2019

(54) PROTECTIVE COVERING WITH TRANSITIONING COUPLING REGION

(71) Applicant: NIKE, Inc., Beaverton, OR (US)

(72) Inventors: Ryan P. Henry, Beaverton, OR (US); Jorge E. Carbo, Jr., Beaverton, OR (US); Kevin C. Sze, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/640,849

(22) Filed: Mar. 6, 2015

(65) Prior Publication Data

US 2016/0255885 A1 Sep. 8, 2016

(51) Int. Cl.

| | |
|---|---|
| ***A41D 13/015*** | (2006.01) |
| ***A41D 13/00*** | (2006.01) |
| ***A41D 13/05*** | (2006.01) |
| ***A63B 71/12*** | (2006.01) |
| ***A63B 71/10*** | (2006.01) |

(52) U.S. Cl.

CPC ..... *A41D 13/015* (2013.01); *A41D 13/0002* (2013.01); *A41D 13/05* (2013.01); *A63B 71/1225* (2013.01); *A63B 71/10* (2013.01); *A63B 71/12* (2013.01); *A63B 2071/1241* (2013.01); *A63B 2071/1258* (2013.01); *A63B 2209/00* (2013.01)

(58) Field of Classification Search

CPC ..... A63B 2071/1258; A63B 71/1225; A63B 2071/1233; A63B 2071/1241; A63B 2071/125; A63B 2071/1266; A41D 13/015; A41D 13/05; A41D 13/0543; Y10T 156/1002

USPC ..... 2/463, 464, 466, 22, 24, 16, 455, 467

See application file for complete search history.

(56) References Cited

U.S. PATENT DOCUMENTS 4,257,414 A * 3/1981 Gamm ..... A63B 71/1216 602/67

6,319,219 B1 * 11/2001 Landi ..... A63B 71/12 128/846

6,334,443 B1 1/2002 Olsen (Continued)

OTHER PUBLICATIONS

International Search Report and Written Opinion dated May 12, 2016 for PCT Application No. PCT/US2016/020958, 14 pages.

(Continued)

*Primary Examiner* — Anna K Kinsaul
*Assistant Examiner* — F Griffin Hall
(74) *Attorney, Agent, or Firm* — Shook, Hardy & Bacon L.L.P.

(57) ABSTRACT

A protective covering is provided having a central protective plate portion and a terminal edge portion encircling the central protective plate portion. A coupling region is interposed between the terminal edge portion and the central protective plate portion. The coupling region transitions from a pliable material of the terminal edge portion to a rigid material of the central protective plate portion, where the coupling region extends from a first edge to a second edge. The first edge has a higher concentration of the pliable material than the rigid material and the second edge has a higher concentration of the rigid material than the pliable material. A first surface of the coupling region has a higher concentration of the pliable material than the rigid material and a second surface of the coupling region has a higher concentration of the rigid material than the pliable material.

19 Claims, 4 Drawing Sheets

(56) References Cited

U.S. PATENT DOCUMENTS

| | | | | |
|---|---|---|---|---|
| 6,591,429 | B1 * | 7/2003 | Jaszai | A41C 3/065 2/455 |
| 7,661,148 | B2 * | 2/2010 | Landi | A41D 13/05 2/16 |
| 8,500,669 | B2 * | 8/2013 | Sheu | A63B 71/1216 2/466 |
| 2004/0024341 | A1 * | 2/2004 | Jacobs | A63B 71/1216 602/72 |
| 2005/0039245 | A1 * | 2/2005 | Landi | A41D 13/05 2/455 |
| 2008/0201829 | A1 * | 8/2008 | Wang | A63B 71/1216 2/466 |
| 2009/0100563 | A1 | 4/2009 | Behrend et al. | |

OTHER PUBLICATIONS

International Preliminary Report on Patentability dated Sep. 21, 2017 in International Patent Application No. PCT/US2016/020958.

* cited by examiner

PROTECTIVE COVERING WITH TRANSITIONING COUPLING REGION

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates to protective coverings. More particularly, the present disclosure relates to athletic guards comprising multiple materials.

BACKGROUND

Participants of athletic or other physical activities often wear one or more protective coverings to reduce the intensity of any resultant impacts to the body that may occur. Contact sports such as football and hockey are especially likely to cause high impacts to the body and therefore players often wear athletic guards to reduce the risk of injury. Examples of protective coverings include hand pads, elbow pads, thigh guards, shin guards, and knee pads. Typically a variety of materials with varying properties can be employed to provide a more robust protective covering. However, due to the strenuous nature of physical activities, the materials that make up the protective covering can unintentionally separate, thereby compromising the integrity of the protective covering.

SUMMARY

This Summary is provided to introduce a selection of concepts in a simplified form that are further described below in the Detailed Description. This Summary is not intended to identify key features or essential elements of the claimed subject matter, nor is it intended to be used as an aid in determining the scope of the claimed subject matter. The present invention is defined by the claims.

At a high level, aspects herein relate to protective coverings, such as athletic guards. A protective covering may comprise a central protective plate portion formed from, for instance, a rigid material that provides structural support and shields a wearer of the protective covering from impact. As used throughout this disclosure, the term "rigidity" refers to the extent to which a material resists deformation in response to an applied force. The rigidity of a material can be established by American Society for Testing and Materials (ASTM) standard testing methods, by way of example.

The protective covering may also comprise a terminal edge portion that at least partially encircles the plate portion. The edge portion can be formed from, for instance, a pliable material that absorbs impacts to the protective covering while providing a comfortable interface between the wearer and the protective covering. As used throughout this disclosure, "pliability" refers to the extent to which a material yields to deformation in response to an applied force.

The pliable material of the edge portion is less rigid (i.e., has lower rigidity) than the rigid material of the plate portion. In turn, the rigid material of the plate portion is less pliable (i.e., has lower pliability) than the pliable material of the edge portion. Including materials comprising at least the pliable and rigid materials allows for a robust protective covering.

In an exemplary aspect, a coupling region may be interposed between the terminal edge portion and the central protective plate portion. The coupling region can transition from the pliable material of the terminal edge portion to the rigid material of the central protective plate portion, where the coupling region extends from a first edge to a second edge. The first edge has a higher concentration of the pliable material than the rigid material, and the second edge has a higher concentration of the rigid material than the pliable material. Furthermore, a first surface (e.g., a top surface) of the coupling region has a higher concentration of the pliable material than the rigid material, and a second surface (e.g., a bottom surface opposing the top surface) of the coupling region has a higher concentration of the rigid material than the pliable material. The coupling region can facilitate a strong bond between the pliable and rigid materials, that respectively make up the edge portion and the plate portion, which is resistant to the materials unintentionally separating.

In certain aspects, the edge portion may comprise a lip that extends around the periphery thereof. The lip may form a stitch groove that can enhance the resilience of stitching situated therein. The edge portion may also comprise a rounded terminal that flares away from an individual in an as-worn position. Use of the rounded terminal may help to alleviate pressure points which may otherwise form at areas where the edge portion engages the individual. The lip and the rounded terminal may be formed from a flared lip that may extend around the periphery of the edge portion. The flared lip can be employed to effectively form the lip and the rounded terminal.

In some aspects, the protective plate has a curved bottom portion to conform to a portion of an individual being protected. The protective plate may have at least one convex extent and at least one concave extent along a cross section that is perpendicular to a top surface and/or bottom surface thereof. Such a configuration can enhance the conformity of the protective plate as well as the bending stiffness of the protective covering.

BRIEF DESCRIPTION OF THE DRAWINGS

Examples are described in detail below with reference to the attached drawing figures, wherein.

DETAILED DESCRIPTION

Figure 1:
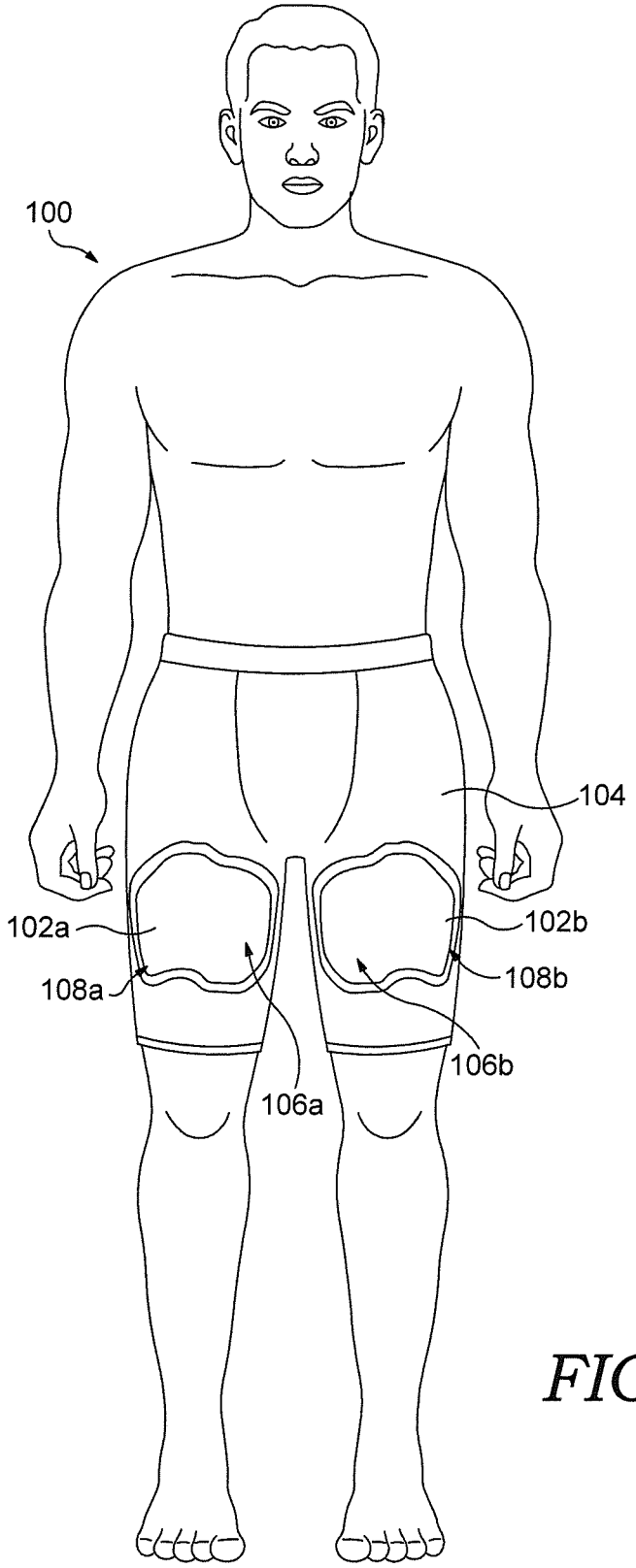
FIG. 1 depicts an individual wearing exemplary protective coverings in accordance with aspects of the present disclosure.

Aspects herein relate to a protective covering, such as an athletic guard. The protective covering may comprise a plate portion formed from, for instance, a rigid material that provides structural support and shields a wearer of the protective covering from impact. The protective covering may also comprise an edge portion that at least partially encircles the plate portion. The edge portion can be formed from, for instance, a pliable material that absorbs impacts to the protective covering while providing a comfortable interface between the wearer and the protective covering that reduces bruising or compressive-type injuries.

The pliable material of the edge portion is less rigid (i.e. has lower rigidity) than the rigid material of the plate portion. In turn, the rigid material of the plate portion is less pliable (i.e. as lower pliability) than the pliable material of the edge portion. Including materials comprising at least the pliable and rigid materials allows for a robust protective covering.

In an exemplary aspect, a coupling region may be interposed between the edge portion and the plate portion. The coupling region can transition from the pliable material of the terminal edge portion to the rigid material of the central protective plate portion, where the coupling region extends from a first edge to a second edge. The first edge has a higher concentration of the pliable material than the rigid material and the second edge has a higher concentration of the rigid material than the pliable material. Furthermore, a first surface of the coupling region has a higher concentration of the pliable material than the rigid material and a second surface (e.g. a surface opposing the first surface) of the coupling region has a higher concentration of the rigid material than the pliable material. The coupling region can facilitate a strong bond between the pliable and rigid materials that helps to prevent the materials from unintentionally separating.

In certain aspects, the edge portion may comprise a lip that extends around the periphery thereof. The lip may form a stitch groove that can enhance the resilience of stitching situated therein. The edge portion may also comprise a rounded terminal that flares away from an individual in an as-worn position. Use of the rounded terminal may alleviate pressure points which may otherwise form at areas where the edge portion engages the individual. The lip and the rounded terminal may be formed from a flared lip that may extend around the periphery of the edge portion. The flared lip can be employed to effectively form the lip and the rounded terminal.

In some aspects, the protective plate has a curved bottom portion to conform to a portion of an individual being protected. The protective plate may have at least one convex extent and at least one concave extent along a cross section that is perpendicular to a top surface and/or bottom surface thereof. Such a configuration can enhance the conformity of the protective plate as well as the bending stiffness of the protective covering.

Protective coverings as contemplated herein can have general configurations suitable for various activities, and for protecting various portions of an individual. The features or aspects included in a particular protective covering as well as the form and composition of those features can vary from specific implementations shown in order to comply with these and other considerations. Thus, while thigh guards are depicted for illustrative purposes, concepts described herein may be applied to a variety of other types of protective coverings, including other types of athletic guards, such as shin guards, leg guards, head guards, arm guards, etc.

FIG. 1 depicts individual 100 wearing exemplary protective coverings 102*a* and 102*b* that will be described for reference purposes. In FIG. 1, protective coverings 102*a* and 102*b* are depicted in as-worn positions with respect to individual 100. In as-worn positions, protective covering 102*a* comprises medial plate portion 106*a* and lateral plate portion 108*a* and protective covering 102*b* comprises medial plate portion 106*b* and lateral plate portion 108*b*. Securing means can be utilized to secure protective coverings 102*a* and 102*b* to individual 100. In some implementations, the securing means can comprise one or more straps and/or bands, which can be attached to or integrated into one or more of protective coverings 102*a* and 102*b*. Various securing means are contemplated by the present disclosure, which is not limited to any particular securing means described herein.

In the implementation shown in FIG. 1, the securing means comprises apparel 104, by way of example. In particular, protective coverings 102*a* and 102*b* are attached to apparel 104 and are secured to individual 100 by apparel 104. Protective coverings 102*a* and 102*b* can be attached to apparel 104 in various ways, such as by way of one or more adhesives and/or one or more pockets. As later discussed in further detail below, additionally, or instead of one or more adhesives and/or pockets, protective coverings 102*a* and 102*b* can be attached to apparel 104 by way of stitching protective coverings 102*a* and 102*b* to apparel 104.

Apparel 104 has the general configuration of pants-type apparel, which includes any of a plurality of articles of apparel that cover a portion of a pelvic area of individual 100 and may extend over legs of individual 100. Although apparel 104 is depicted as being a pair of shorts, exemplary aspects described herein also apply to other pants-type apparel, including pants, briefs, jeans, and underwear. Also, the exemplary aspects described herein apply to shirt-type apparel, which cover a portion of a torso area of individual 100 and can extend over arms of individual 100. Examples of shirt-type apparel include long-sleeved shirts, short-sleeved shirts, tank tops, undershirts, jackets, and coats. A shirt-type appeal may be suitable where one or more protective coverings are arm guards, elbow pads, stomach guards, back guards, shoulder pads, and the like.

The exemplary aspects described herein also apply to combinations of shirt-type apparel and pants-type apparel, including bodysuits, leotards, unitards, and wetsuits. Furthermore, the apparel can have configurations that cover other areas of individual 100, such as hats, helmets, gloves, socks, and footwear, for example. Apparel 104 can be worn in combination with other articles of apparel (e.g., under or over other articles of apparel). Furthermore, apparel 104 can be worn in combination with other pieces of equipment (e.g., athletic or protective equipment). It should be appreciated that the manner in which apparel 104 is configured and is worn by individual 100 can vary significantly. Apparel 104 corresponds to one effective means for securing a protective covering to individual 100; however, apparel 104 is not required.

By securing protective coverings 102*a* and 102*b* to individual 100, protective coverings 102*a* and 102*b* can cover underlying regions, areas, or portions of individual 100 for protection thereof. In particular, protective coverings 102*a* and 102*b* can distribute or attenuate impact forces to individual 100 in those regions, thereby imparting protection to individual 100. FIG. 1 depicts an implementation where protective coverings 102*a* and 102*b* are thigh guards. However, in various implementations, protective coverings 102*a* and/or 102*b* can be configured as hand pads, elbow pads, shin guards, knee pads, foot guards, head guards, or other types of protective coverings.

Figure 2A:
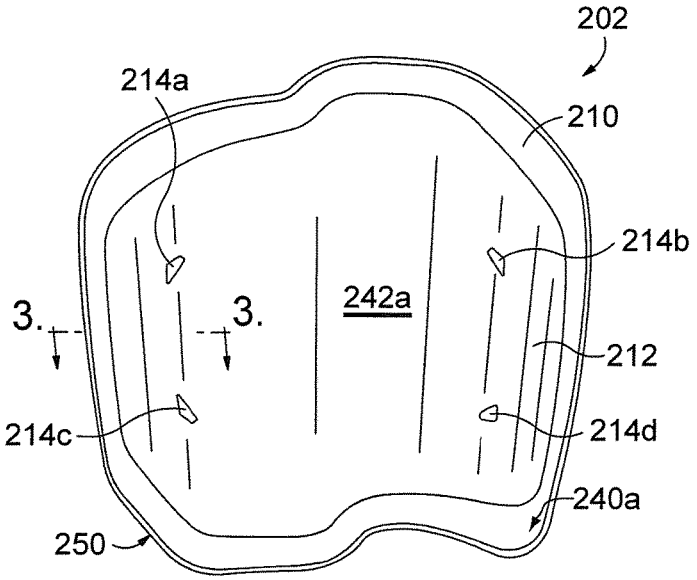
FIG. 2A depicts a top view of an exemplary protective covering in accordance with aspects of the present disclosure.
Figure 2B:
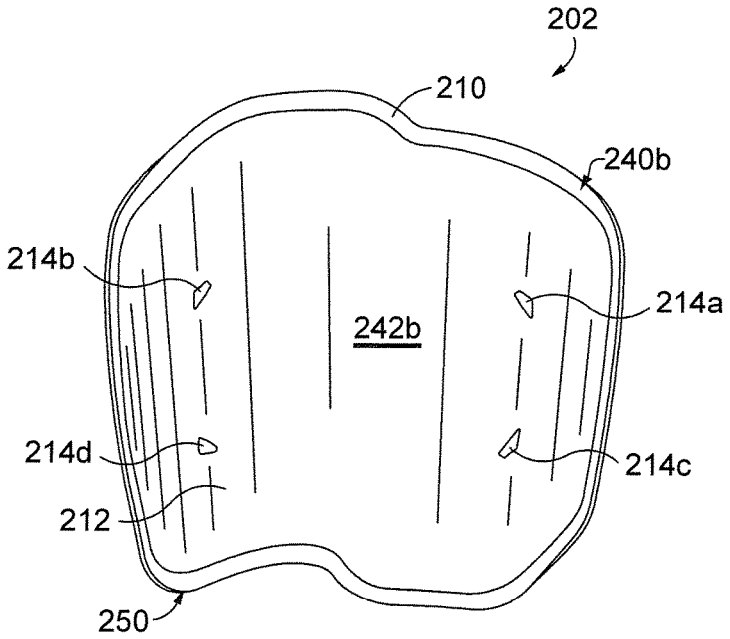
FIG. 2B depicts a bottom view of an exemplary protective covering in accordance with aspects of the present disclosure.

Referring now to FIGS. 2A and 2B, FIG. 2A depicts a top view of exemplary protective covering 202 and FIG. 2B depicts a bottom view of exemplary protective covering 202 that will be described for reference purposes. Protective covering 202 may correspond to protective covering 102*b* in FIG. 1. However, protective covering 102*a* is also similar to protective covering 202 and is therefore not described in significant detail. In particular, protective covering 102*a* is primarily distinguished from protective covering 102*b* in that protective covering 102*a* is configured to be worn on the right side of individual 100 whereas protective covering 102*b* is configured to be worn on the left side of individual 100. However, it is noted that in various implementations, protective coverings, such as protective coverings 102*a* and/or 102*b* are not configured for a particular side of individual 100. Furthermore, a protective covering as contemplated by the present disclosure does not necessarily require a counterpart protective covering.

As shown in FIGS. 2A and 2B, protective covering 202 comprises edge portion 210 and protective plate portion 212. In the implementation shown, edge portion 210 is a terminal edge portion of protective covering 202, by way of example. In particular, edge portion 210 forms a terminal edge of protective covering 202. In various implementations, edge portion 210 at least partially encircles protective plate portion 212, and in the implementation shown, completely encircles protective plate portion 212. In FIGS. 2A and 2B, edge portion 210 is annular and is surrounding protective plate portion 212. Edge portion 210 can form a gasket of protective covering 202 when mated with an individual, such as individual 100 in FIG. 1 in an as-worn position. In other words, edge portion 210 can be used to provide a seal between the individual and protective covering 202. Protective plate portion 212 is centrally positioned in protective covering 202 and can be referred to as a central protective plate portion of protective covering 202.

Protective plate portion 212 comprises rigid material and can be referred to as a rigid protective plate portion. In some aspects, an entirety of protective plate portion 212 can be formed from the rigid material. Edge portion 210 comprises pliable material and can be referred to as a pliable edge portion. In some aspects, an entirety of edge portion 210 can be formed from the pliable material.

The pliable material of edge portion 210 is of lower rigidity than the rigid material of protective plate portion 212. The lower rigidity can be established by ASTM standard testing methods, by way of example. The pliable material and rigid material can be any of various combinations of polymers. Exemplary pliable material includes polymers, such as phenylene oxide (PPE), thermoplastic polyurethane (TPU), polypropylene, and acrylonitrile butadiene styrene (ABS) TPU. Exemplary rigid materials include semi-rigid flexible polymers, such as a polycarbonate/acrylonitrile-butadiene-styrene (PCABS) blend, carbon fiber, ABS, polystyrene, polypropylene, and nylon. Exemplary hardness can range from approximately Soft Shore 40 for the pliable material to approximately Soft Shore 100 for the rigid material.

Employing at least the rigid and pliable materials having varying properties can result in a more robust protective covering. For example, the rigid material of protective plate portion 212 can substantially contribute to structurally supporting protective covering 202 and shielding a wearer from impact. In an as-worn position, surface 242*a* of protective plate portion 212 may face away from an individual, such as individual 100 of FIG. 1, to receive contact, while surface 242*b* of protective plate portion 212 faces the individual.

The pliable material of edge portion 210 can substantially contribute to absorbing the impact. Furthermore, the pliable material can be configured to engage the wearer of protective covering 202, such as individual 100, as indicated in FIG. 2B. In particular, in an as-worn position surface 240*a* of edge portion 210 may face away from the individual while surface 240*b* of edge portion 210 engages the individual. The pliable material of edge portion 210 is generally softer and more compliant than the rigid material of protective plate portion 212, making for a more comfortable interface between protective covering 202 and individual 100 that reduces bruising.

Due to the strenuous nature of physical activities there is a risk that the rigid and pliable materials unintentionally separate, thereby compromising the integrity of the protective covering. In accordance with implementations of the present disclosure, the protective covering can include a coupling region that substantially reduces the risk of the rigid and pliable materials unintentionally separating.

Figure 3:
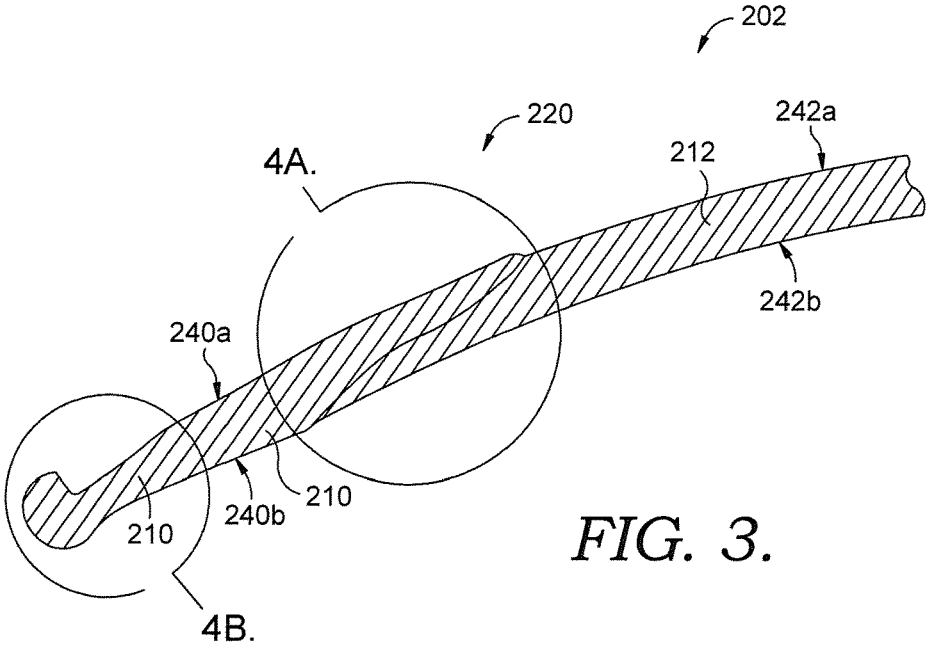
FIG. 3 depicts a cross-section taken along cut line 3-3 of FIGS. 2A and 2B in accordance with aspects of the present disclosure.

FIG. 3 depicts a cross-section taken along cut line 3-3 of FIGS. 2A and 2B. As shown, protective covering 202 comprises coupling region 220. Coupling region 220 is interposed between edge portion 210 and protective plate portion 212. Coupling region 220 at least partially encircles protective plate portion 212 and can completely encircle protective plate portion 212. In the implementation shown, coupling region 220 surrounds protective plate portion 212. Coupling region 220 is continuous in its extent around protective plate portion 212 in the present example, but could include one or more gaps along that extent. Coupling region 220 can be coextensive with edge portion 210 and acts as an interface between the pliable material of edge portion 210 and the rigid material of protective plate portion 212.

Coupling region 220 is transitioning from the pliable material of edge portion 210 to the rigid material of protective plate portion 212. In the present implementation, coupling region 220 is continuous with the pliable material that makes of edge portion 210, and is further continuous with the rigid material that makes of protective plate portion 212.

Figure 4A:
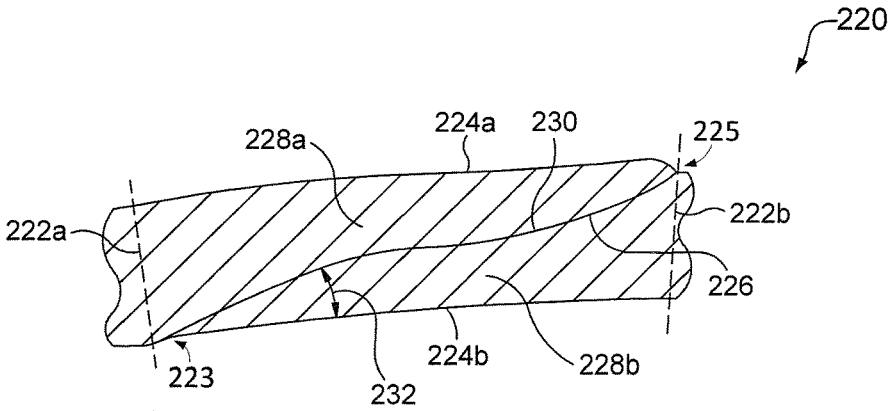
FIG. 4A depicts an expanded view of portion 4A-4A of the cross-section depicted in FIG. 3 in accordance with aspects of the present disclosure.

Referring to FIG. 4A, FIG. 4A depicts an expanded view of portion 4A-4A of the cross-section depicted in FIG. 3 in accordance with aspects of the present disclosure. As shown, coupling region 220 extends generally from edge 222*a* to edge 222*b*. Edge 222*a* has a higher concentration of the pliable material than the rigid material, and edge 222*b* has a higher concentration of the rigid material than the pliable material. Furthermore, surface 224*a* of coupling region 220 (e.g., a top surface) has a higher concentration of the pliable material than the rigid material and opposing surface 224*b* (e.g., a bottom surface) of the coupling region has a greater concentration of the rigid material than the pliable material.

Coupling region 220 is adapted to provide a large contact area between the pliable and rigid materials resulting in a strong bond between edge portion 210 and protective plate portion 212, which reduces the risk of unintentional separation between the pliable and rigid materials. Furthermore, coupling region 220 has torsion regions 228*a* and 228*b*, which may be generated by bending surfaces 224*a* and 224*b* and are typical regions at which protective covering 202 may be subjected to high torsion during physical activity of a wearer. Due to the composition of those regions, torsion regions 228*a* and 228*b* are structurally resilient, particularly in relation to regions adjacent graded interface 230. Therefore, the risk of unintentional separation between the pliable and rigid materials is further reduced.

Coupling region 220 can include graded interface 230 between the pliable material and the rigid material, which is sloped to form a large contact area as opposed to being substantially perpendicular to the surface 224*a* and the surface 224*b*. While graded interface 230 is curved or sloped as shown, graded interface 230 could optionally include one or more steps along its extent. Graded interface 230 spans edges 222*a* and 222*b* of coupling region 220. As shown, graded interface 230 forms angle 232 with surface 224*b* of coupling region 220 at edge 222*a*. Angle 232 may remain less than 90 degrees between edges 222*a* and 222*b*, although angle 232 can vary along that extent, as shown. In various implementations, angle 232 remains 45 degrees or less between edges 222*a* and 222*b*. The length of graded interface 230 can be, for example, from approximately 8 millimeters to approximately 14 millimeters.

In some implementations, coupling region 220 is chemically and mechanically attaching edge portion 210 and protective plate portion 212. The chemical and mechanical attachment can enhance the integrity of the bond between the pliable and rigid materials. For example, in some cases, the pliable material of edge portion 210 and the rigid material of protective plate portion 212 are chemically cross-linked across coupling region 220. This can be achieved, for example, by co-molding edge portion 210 with protective plate portion 212. In particular, the pliable material (e.g., a polymer) can be co-molded with the rigid material (e.g., a semi-rigid flexible polymer) to achieve coupling region 220.

In some respects, the pliable material of edge portion 210 spaces surface 224*b* of coupling region 220 from individual 100 when protective covering 202 is worn by individual 100. The spacing can prevent or reduce contact between individual 100 and surface 224*b*, which may result in protective covering being more comfortable for individual 100 because surface 224*b* primarily comprises the rigid material. In some cases the spacing is achieved by providing offset 223 between surface 224*b* (e.g., a bottom surface) of coupling region 220 and surface 240*b* of edge portion 210, as indicated in FIG. 4A. For example, surface 240*b* of edge portion 210 may be situated at least partially below surface 224*b* of coupling region 220, as shown at edge 222*a* in FIG. 4A.

Also shown in FIG. 4A, surface 224*a* of coupling region 220 is substantially continuous with surface 240*a* (e.g., a top surface) of edge portion 210. Furthermore, surface 224*b* of coupling region 220 is substantially continuous with surface 242*b* (e.g. a bottom surface) of protective plate portion 212. Also, surface 242*a* of protective plate portion 212 is recessed, or situated below, surface 224*a* of coupling region 220 at edge 222*b*, as indicated by offset 225. It is noted that any of the various relationships between respective surfaces of coupling region 220, edge portion 210 and protective plate portion 212 are optional and can vary between implementations of the present disclosure.

Figure 4B:
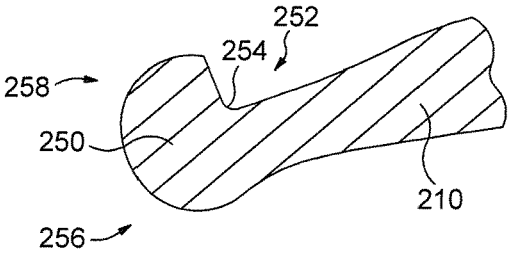
FIG. 4B depicts an expanded view of portion 4B-4B of the cross-section depicted in FIG. 3 in accordance with aspects of the present disclosure.

Referring to FIG. 4B, FIG. 4B depicts an expanded view of portion 4B-4B of the cross-section depicted in FIG. 3 in accordance with aspects of the present disclosure. In some aspects of the present disclosure, edge portion 210 extends into flared lip 250. Flared lip 250 can at least partially encircle or surround protective plate portion 212. As shown, flared lip 250 is defined by rounded terminal 256 and lip 258 of edge portion 210. While protective covering 202 comprises both rounded terminal 256 and lip 258, other protective coverings contemplated herein comprise only rounded terminal 256 or lip 258, or neither of rounded terminal 256 and lip 258. Flared lip 250 is but one approach to efficiently and effectively forming rounded terminal 256 and lip 258.

Lip 258 can form stitch groove 252 in edge portion 210. Stitching 254 can optionally be situated in stitch groove 252 so as to secure protective covering 202 to apparel, such as apparel 104 in FIG. 1, and/or other structures or backings. Situating stitching 254 in the protected area provided by the stitch groove 252 can enhance the resilience of stitching 254 to edge effects that may work to compromise stitching 254.

Rounded terminal 256 of edge portion 210 flares away from individual 100 of FIG. 1 in an as-worn position. In doing so, rounded terminal 256 can help to alleviate pressure points which can form at points where protective covering 202 engages individual 100. Therefore, rounded terminal 256 can enhance the comfort of individual 100 while wearing protective covering 202.

In the implementation shown, the pliable material of edge portion 210 and the rigid material of protective plate portion 212 are exposed. However, either of the pliable material of edge portion 210 and/or the rigid material of protective plate portion 212 can be exposed or can be covered by other materials in various implementations.

Returning to FIGS. 2A and 2B, protective plate portion 212 optionally includes one or more openings, such as openings 214*a*, 214*b*, 214*c*, and 214*d*, which extend through surface 242*a* and surface 242*b* of protective plate portion 212. The openings can be of any suitable shape and can be distributed across the rigid material of protective plate portion 212 in any suitable arrangement. The openings can provide ventilation to individual 100 when wearing protective covering 202. As protective, plate portion 212 may be at least partially spaced from individual 100 when worn, such that air can effectively flow through the openings in the rigid material.

Surface 242*b* of protective plate portion 212 can optionally be curved in an unflexed position as indicated in FIG. 3. By curving surface 242*b*, protective, covering 202 can conform to a portion of individual 100 being protected (e.g., a thigh in FIG. 1). Surface 242*a* can also optionally be curved and any curves in surface 242*a* can track underlying curves of surface 242*b*, as in the implementation shown, or surfaces 242*a* and 242*b* can have different curvatures. In some aspects of the present disclosure, protective covering 202 (e.g., surface 242*b*) has at least one convex extent and at least one concave extent along a cross section that is perpendicular to surface 242*a* and/or surface 242*b* thereof. Doing so can enhance the bending stiffness of protective covering 202 as well as resulting in improved conformity to the portion of individual 100 being protected by protective covering 202. An example, of such a configuration is shown with respect to FIGS. 5A, 5B, 5C, and 5D for reference purposes.

Figure 5B:
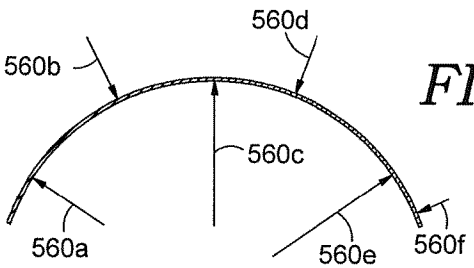
FIG. 5B depicts a base curvature profile along cut line 5B-5B depicted in FIG. 5A in accordance with aspects of the present disclosure.
Figure 5C:
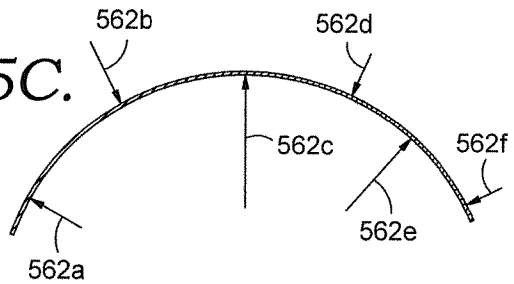
FIG. 5C depicts a base curvature profile along cut line 5C-5C depicted in FIG. 5A in accordance with aspects of the present disclosure.
Figure 5D:
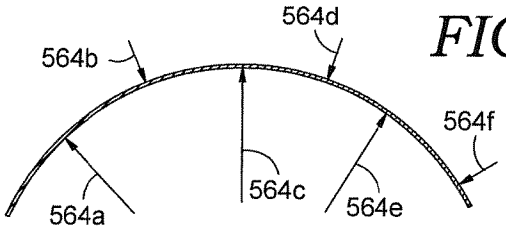
FIG. 5D depicts a base curvature profile along cut line 5D-5D depicted in FIG. 5A in accordance with aspects of the present disclosure.
Figure 5A:
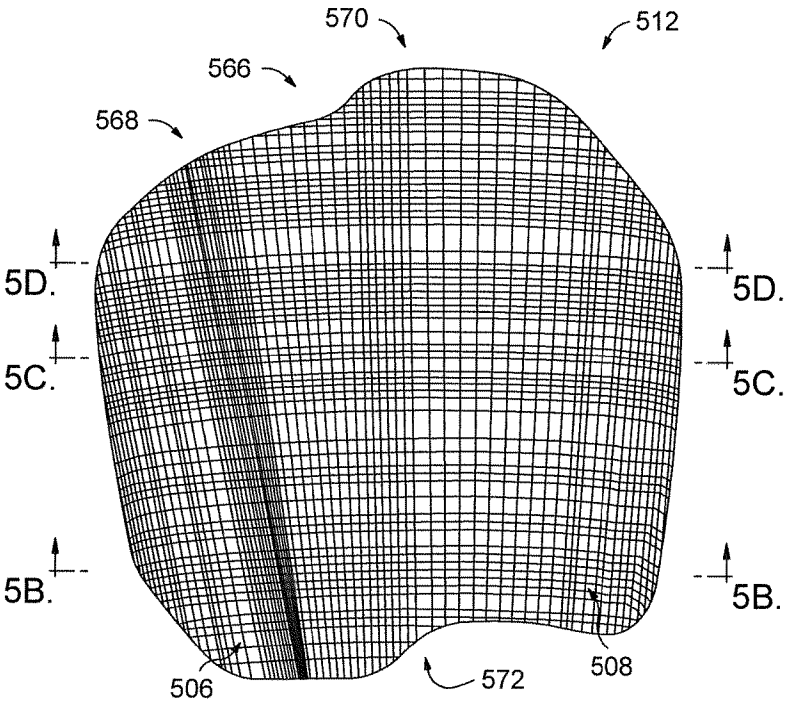
FIG. 5A depicts a top view of an exemplary protective plate of a protective covering in accordance with aspects of the present disclosure.

Referring to FIG. 5A, FIG. 5A depicts a top view of protective plate portion 512 in accordance with aspects of the present disclosure. Protective plate portion 512 corresponds to protective plate portion 212 of protective covering 202. FIGS. 5B, 5C, and 5D depict base curvature profiles along respective cut lines 5B-5B, 5C-5C, and 5D-5D depicted in FIG. 5A in accordance with aspects of the present disclosure.

FIG. 5B shows base curves 560*a*, 560*b*, 560*c*, 560*d*, 560*e*, and 560*f*, which are depicted at relative positions along cut line 5B-5B. Similarly, FIG. 5C shows base curves 562*a*, 562*b*, 562*c*, 562*d*, 562*e*, and 562*f*, which are depicted at relative positions along cut line 5C-5C. Also, FIG. 5D shows base curves 564*a*, 564*b*, 564*c*, 564*d*, 564*e*, and 564*f*, which are depicted at relative positions along cut line 5D-5D. The base curves for each given cross-section can define a respective spline in the bottom surface of protective plate portion 512 (i.e., surface 242*b*). The depicted base curvature profiles and base curves are merely exemplary and can vary from the present example, particularly for protective coverings that are adapted to be worn on other body regions.

As can be seen, the cross sections have multiple base curves forming lateral extents that span the outer edges of medial and lateral plate portions 506 and 508 of protective plate portion 512. Medial and lateral plate portions 506 and 508 correspond respectively to medial and lateral plate portions 106*b* and 108*b* in FIG. 1. The lateral extents collectively form contact groove 572 that runs perpendicular thereto and is configured to receive a portion of individual 100 being protected. The base curves are such that protective plate portion 512 has at least one convex extent 566 between concave extents 568 and 570. Such a configuration can enhance the bending stiffness protective plate 512 as well as resulting in improved conformity to the portion of individual 100 being protected. In the present example, concave extent 568 is at least partially in medial plate portion 506 and concave extent 570 is at least partially in lateral plate portion 508. The number and location of concave and convex extents can vary, for example, to conform to different portions of individual 100 being protected as well as other criteria. For example, some implementations of protective plate portion 512 include a single concave extent.

Thus, in accordance with implementations of the present disclosure, a protective covering can comprise an edge portion of pliable material and a plate portion of rigid material. A coupling region can be employed that reduces the risk of the pliable material unintentionally separating from the rigid material. Therefore, the protective covering can be made robust while being structurally resilient.

Many different arrangements of the various components depicted, as well as components not shown, are possible without departing from the scope of the claims below. Aspects of our technology have been described with the intent to be illustrative rather than restrictive. Alternative aspects will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. An athletic guard comprising: a central protective plate portion comprising a rigid material; a terminal edge portion at least partially encircling the central protective plate portion, the terminal edge portion comprising a pliable material of lower rigidity than the rigid material; and a coupling region comprising a graded interface, the coupling region transitioning from the pliable material of the terminal edge portion to the rigid material of the central protective plate portion, wherein the graded interface extends across the coupling region from a first edge to a second edge of the coupling region and from a first surface to a second surface of the coupling region, the graded interface forming a first acute angle with the first surface of the coupling region and a second acute angle with the second surface of the coupling region, the first edge comprising the pliable material and the second edge comprising the rigid material, the first surface being the rigid material and the second surface being the pliable material, wherein the first surface opposes the second surface over the length of the graded interface.

2. The athletic guard of claim 1, wherein the coupling region at least partially encircles the central protective plate portion.

3. The athletic guard of claim 1, wherein the terminal edge portion completely encircles the central protective plate portion.

4. The athletic guard of claim 1, wherein the coupling region is chemically and mechanically attaching the terminal edge portion and the central protective plate portion.

5. The athletic guard of claim 1, wherein the pliable material of the terminal edge portion and the rigid material of the central protective plate portion are chemically cross-linked across the coupling region.

6. The athletic guard of claim 1, wherein the second surface of the coupling region is substantially continuous with a second surface of the terminal edge portion.

7. The athletic guard of claim 1, wherein the first surface of the coupling region is substantially continuous with a second surface of the central protective plate portion.

8. The athletic guard of claim 1, wherein the terminal edge portion extends into a flared lip.

9. The athletic guard of claim 1, wherein the terminal edge portion comprises a rounded terminal.

10. The athletic guard of claim 1, wherein the central protective plate portion has at least one convex extent and at least one concave extent along a cross section that is perpendicular to a first surface thereof.

11. The athletic guard of claim 1, wherein the rigid material is a semi-rigid flexible polymer and the pliable material is a polymer.

12. An athletic guard comprising: a rigid protective plate portion; a pliable edge portion surrounding the rigid protective plate portion, the pliable edge portion being of lower rigidity than the rigid protective plate portion; and a coupling region comprising a graded interface, the pliable edge portion and the rigid protective plate portion being chemically cross-linked across the coupling region, in which a first material forming the pliable edge portion transitions into a second material forming the rigid protective plate portion, the graded interface extending across the coupling region from a first edge to a second edge of the coupling region and from a first surface to a second surface of the coupling region, the graded interface forming a first acute angle with the first surface of the coupling region and a second acute angle with the second surface of the coupling region, the first edge comprising the first material and the second edge comprising the second material, the first surface being the first material and the second surface being the second material wherein the first surface opposes the second surface over the length of the graded interface.

13. The athletic guard of claim 12, wherein the pliable edge portion is co-molded with the rigid protective plate portion.

14. The athletic guard of claim 12, wherein the coupling region surrounds the rigid protective plate portion.

15. The athletic guard of claim 12, wherein the first surface of the coupling region is substantially continuous with a first surface of the pliable edge portion and the second surface of the coupling region is substantially continuous with a second surface of the rigid protective plate portion.

16. A protective covering comprising:

a protective plate portion constructed of a rigid material, the protective plate portion comprising a medial plate portion and a lateral plate portion when in an as-worn position;

a terminal edge portion surrounding the protective plate portion, the terminal edge portion constructed of a pliable material of lower rigidity than the rigid material; and a coupling region comprising a graded interface interposed between the protective plate portion and the terminal edge portion, the coupling region chemically and physically attaching the terminal edge portion to the protective plate portion, the coupling region transitioning from the pliable material of the terminal edge portion to the rigid material of the protective plate portion, wherein the graded interface extends from a first edge to a second edge of the coupling region and from a first surface to a second surface of the coupling region, the graded interface forming a first acute angle with the first surface of the coupling region and a second acute angle with the second surface of the coupling region, the first edge comprising the pliable material and the second edge comprising the rigid material, the first surface being the rigid material and the second surface being the pliable material, wherein the first surface opposes the second surface over the graded interface.

17. The protective covering of claim 16, wherein the protective plate portion has at least one convex extent between a concave extent in the medial plate portion and a concave extent in the lateral plate portion.

18. The protective covering of claim 16, wherein the protective plate portion comprises a contact groove defined by outer edges of the medial plate portion and the lateral plate portion.

19. The protective covering of claim 16, wherein the coupling region surrounds the protective plate portion coextensively with the terminal edge portion.

* * * * *